US008195068B2

(12) United States Patent
Fukunaga et al.

(10) Patent No.: US 8,195,068 B2
(45) Date of Patent: Jun. 5, 2012

(54) CHARGING UNIT AND IMAGE FORMING APPARATUS

(75) Inventors: Yasuyuki Fukunaga, Osaka (JP); Mitsuhiro Goda, Osaka (JP); Yoshitaka Imanaka, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 370 days.

(21) Appl. No.: 12/578,309

(22) Filed: Oct. 13, 2009

(65) Prior Publication Data

US 2010/0183334 A1 Jul. 22, 2010

(30) Foreign Application Priority Data

Jan. 19, 2009 (JP) ..... 2009-008389

(51) Int. Cl.
*G03G 15/02* (2006.01)

(52) U.S. Cl. ..... 399/176; 399/115

(58) Field of Classification Search ..... 399/107, 399/115, 168, 174–176; 361/225, 229; 250/324–326
See application file for complete search history.

(56) References Cited

U.S. PATENT DOCUMENTS

| | | | | |
|---|---|---|---|---|
| 4,851,960 | A | 7/1989 | Nakamura et al. | |
| 5,870,657 | A * | 2/1999 | Nagame et al. | 399/174 |
| 7,035,567 | B2 * | 4/2006 | Gila et al. | 399/91 |
| 2006/0104681 | A1 | 5/2006 | Hanashi | |

FOREIGN PATENT DOCUMENTS

| | | |
|---|---|---|
| JP | 63149669 | 6/1988 |
| JP | 06-175472 | 6/1994 |
| JP | 2006-139155 | 6/2006 |

* cited by examiner

*Primary Examiner* — Hoan Tran
(74) *Attorney, Agent, or Firm* — K&L Gates LLP

(57) ABSTRACT

A charging unit in an image forming apparatus includes a charging roller that charges a photosensitive drum using a charging bias, an insulating casing surrounding the charging roller, and a metal shield member. The shield member is positioned so as to surround the casing in close contact with the outer peripheral surface of the casing.

10 Claims, 8 Drawing Sheets

CHARGING UNIT AND IMAGE FORMING APPARATUS

INCORPORATION BY REFERENCE

This application is based upon and claims the benefit of priority from the corresponding Japanese Patent application No. 2009-008389, filed Jan. 19, 2009, the entire contents of which are incorporated herein by reference.

BACKGROUND

1. Field of the Invention

The present invention relates to an image forming apparatus using an electrophotographic system. More particularly, the present invention relates to a charging unit that charges a photosensitive member with electricity.

2. Description of the Related Art

Conventionally, in an image forming apparatus that use an electrophotographic process, a charging unit is used to charge the surface of an image-bearing member (photosensitive member). As the charging unit, a noncontact charging unit, such as a scorotron charging unit or a corotron charging unit, is used. In addition, in consideration of the environment, a contact charging unit is also used which has a charging member, such as a charging roller or a charging brush, that is in contact with a photosensitive member, to charge the photosensitive drum. By using the contact charging unit, it is possible to reduce the amount of ozone emission.

For example, in the situation where a charging roller is used as the contact charging unit, an electric charge is directly applied to the surface of the photosensitive member by applying a direct-current voltage of about 1 kilovolt to the charging roller that is in contact with the surface of the photosensitive member thereby charging the surface of the photosensitive member to a predetermined potential. However, because the surface of the charging roller, to which the voltage is applied, and the surface of the photosensitive member with which the charging roller is in contact have microscopic irregularities, spot-like charging unevenness can occur on the surface of the photosensitive member.

As a method for preventing such charging unevenness it is known, for example, to uniformly charge the target surface by applying a pulsating-current voltage having a peak-to-peak voltage that is at least twice the charge-starting voltage to an electrically conductive member (charging member). This forms an oscillating electric field between the target member and the electrically conductive member.

As a method for developing an electrostatic latent image formed on the photosensitive member, a so-called jumping development method is sometimes used. This method can develop the electrostatic latent image on the photosensitive member into a visible image by forming a uniform thin developer (toner) layer on a developing roller that functions as a toner bearing member, which is close to the surface of the electrostatic latent image, and applies a developing bias. A direct-current bias and an alternate-current bias are superposed to the developing roller to thereby electrically attract the toner causing the toner to attach to the electrostatic latent image. This improves the stability of the density of the image and reduces fogging.

In such a jumping development method, where a superposed direct-current bias and alternate-current bias is used for both the charging bias and the developing bias, problems with the unevenness of formed images can occur. This can be caused by the frequency of the alternating-current component of the charging being similar to: the frequency of the developing bias; frequency of an integral multiple thereof; or the frequency that is an integral submultiple thereof.

A possible cause of the problems is that when the alternate-current components of the charging bias and the developing bias are applied at a close range, at the same time, electromagnetic induction or the like occurs in the wires of the high-voltage supply board, the charging unit, and the developing unit. Therefore, the alternate-current component of the developing bias may be (electromagnetically) induced into a charging bias. Likewise, the alternating-current component of the charging bias may be (electromagnetically) induced into the developing bias.

In particular, when the alternating-current component of the developing bias is induced into the charging bias, beats are generated between the original frequency of the alternating-current component of the charging bias itself and the frequency of the induced alternating-current component. If these beats cause a charging unevenness during the formation of the electrostatic latent image, the formed image can look jittery, blurry.

Therefore, a method for preventing interference between the charging bias and the developing bias is proposed. For example, a method (hereinafter referred to as "method A") for preventing the occurrence of radiant (electrostatic) noise to avoid surrounding electronic devices from malfunctioning is known. This is accomplished by surrounding a contact nipping portion formed between the charging member and the target member with a shield member formed of a grounded electrically conductive member.

Furthermore, a method (hereinafter referred to as "method B") for preventing charging unevenness due to the close placement of an upstream charging member and a downstream developing unit due to the miniaturization of image forming apparatus and close placement of image forming units is known. The apparatus includes cleaning means having a cleaning member and a grounded conductive support member (a shield member) that supports the cleaning member. The support member is located so as to shield the visual angle between the developing member of the developing means and the charging member that charges the image-bearing member next to the developing member.

However, it is difficult for method A to sufficiently achieve miniaturization because the shield member is located outward, away from the support member (casing) of the charging member. Moreover, to replace the charging unit, for example, it is necessary to remove the charging member together with the casing after the shield member is removed. This can affect the attachment/detachment of the charging unit complicating maintenance work.

Furthermore, due to the gap between the shield member and the casing, the space surrounded by the shield member can widen in the periphery of the portion between the charging unit to which the charging bias is applied and the image-bearing member. Thus, there is the possibility that an electric field, of the developing bias, can leak across the shield member (leaked electric field), which can affect the charging bias.

Furthermore, with method B, the support member (shield member) only covers a part of the casing of the cleaning member or the charging-roller cover (casing), so that the leaked electric field cannot be sufficiently prevented, which can affect the charging bias.

SUMMARY

An advantage of the present invention is to provide a compact charging unit that is easily detachable and easy to maintain and can reduce the influence of the developing bias on the charging bias, as well as an image forming apparatus.

A charging unit according to an embodiment of the present invention includes a charging member, an insulating casing surrounding the charging member, and a metal shield member surrounding the casing; and the metal shield member is located in close contact with an outer peripheral surface of the insulating casing.

An image forming apparatus according to another embodiment of the present invention includes a charging unit; an image-bearing member that is charged by the charging unit; an exposing unit that irradiates light onto the image-bearing member, that is charged by the charging unit to form an electrostatic latent image; and a developing unit that applies a developing bias including an alternating-current component to develop the electrostatic latent image. The charging unit includes a charging member; an insulating casing surrounding the charging member; a metal shield member surrounding the casing; and the metal shield member is located in close contact with an outer peripheral surface of the insulating casing.

Additional features and advantages are described herein, and will be apparent from the following Detailed Description and the figures.

DETAILED DESCRIPTION

Figure 1:
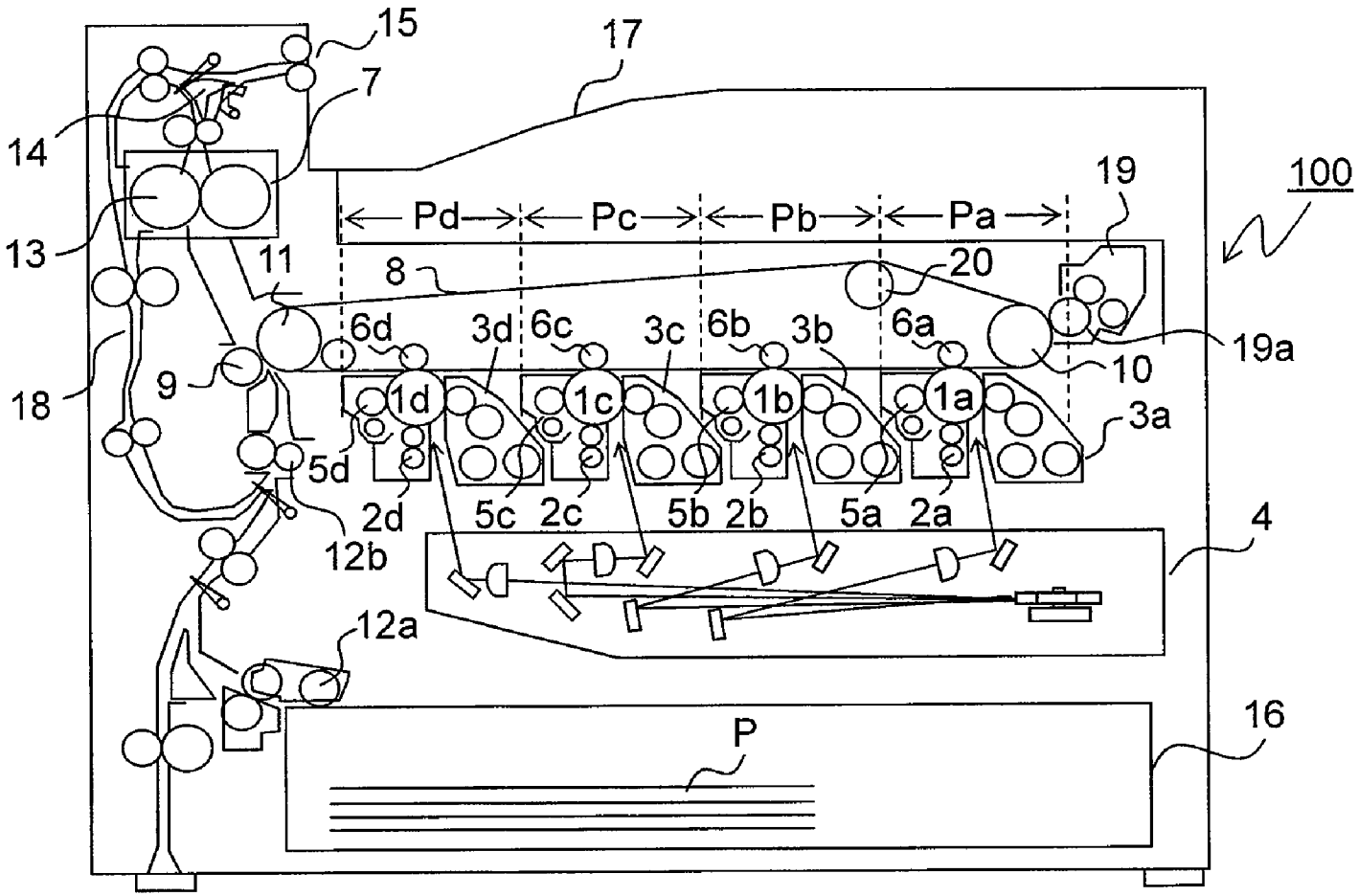
FIG. 1 is a schematic cross-sectional view showing the overall configuration of an image forming apparatus according to an embodiment of the present invention.

Hereinafter, an embodiment of the present invention will be described in detail with reference to the drawings. FIG. 1 is a schematic diagram showing the configuration of a tandem color-image forming apparatus 100 according to an embodiment of the present invention. The main body of the image forming apparatus 100 accommodates four image forming units Pa, Pb, Pc, and Pd, in that order from the upstream side in a transporting direction of an intermediate transfer belt 8 viewed from a belt cleaning unit 19 (the right in FIG. 1). These image forming units Pa to Pd are provided to correspond to four different colors (yellow, cyan, magenta, and black). They form yellow, cyan, magenta, and black images in sequence, respectively, by the individual process of charging, exposure, developing, and transfer.

The image forming units Pa to Pd include photosensitive drums (image-bearing member) 1*a*, 1*b*, 1*c*, and 1*d*, respectively, that carry visual color images (toner images). After the toner images that are formed on the photosensitive drums 1*a* to 1*d* are transferred onto the intermediate transfer belt 8, in sequence in an overlapping manner (primary transfer), moved by a driving unit (not shown), next to the image forming units Pa to Pd, while rotating clockwise in FIG. 1. The toner images are transferred onto the paper P (secondary transfer) by a secondary transfer roller 9, are then fixed onto the paper P by a fixing unit 7. And then, the paper P is outputted from the apparatus. Thus, the image forming processes on the photosensitive drums 1*a* to 1*d* are performed while the photosensitive drums 1*a* to 1*d* rotate in a counter-clockwise direction in FIG. 1.

The paper P, to which the toner images are transferred, are stored in a paper cassette 16 at the lower part of the apparatus 100. The paper P is fed to the secondary transfer roller 9 via a paper feed roller 12*a* and a register roller pair 12*b*. The intermediate transfer belt 8 is made of a dielectric resin sheet; for example, an endless belt having ends that are lap joined into an endless form or a seamless belt can be used. A belt cleaning unit 19 for removing toner that remains on the surface of the intermediate transfer belt 8 is positioned upstream of the image forming unit Pa in the direction the intermediate transfer belt 8 moves.

Now, the image forming units Pa to Pd will be described. The units include around and below the rotatable photosensitive drums 1*a* to 1*d*, charging units 2*a*, 2*b*, 2*c*, and 2*d*, for charging the photosensitive drums 1*a* to 1*d*, an exposure unit (exposing unit) 4 for exposing the photosensitive drums 1*a* to 1*d* to irradiating light corresponding to the image information, and a developing unit 3*a*, 3*b*, 3*c*, and 3*d* for forming toner images on the photosensitive drums 1*a* to 1*d*, and cleaning units 5*a*, 5*b*, 5*c*, and 5*d* for removing developer (toner) remaining on the photosensitive drums 1*a* to 1*d*, respectively.

When the start signal is initiated by the user, first, the surfaces of the photosensitive drums 1*a* to 1*d* are uniformly charged by the charging units 2*a* to 2*d*. Next, the photosensitive drums 1*a* to 1*d* are irradiated with light by the exposure unit 4, forming electrostatic latent images corresponding to an image signal on the individual photosensitive drums 1*a* to 1*d*. The developing units 3*a* to 3*d* are each equipped with a developing roller 27 (toner bearing member, see FIG. 2) located opposite the photosensitive drums 1*a* to 1*d*, and are supplied with a predetermined amount of color toners (yellow, cyan, magenta, and black, respectively), by a supply unit (not shown). The toner is provided to the photosensitive drums 1*a* to 1*d* by the developing rollers 27 of the developing unit 3*a* to 3*d*, and are electrostatically attached thereto, forming toner images corresponding to the electrostatic latent images, by the exposure unit 4.

Then, while an electric field having a predetermined transfer voltage is applied to the transfer rollers 6*a* to 6*d*, the yellow, cyan, magenta, and black toner images on the photosensitive drums 1*a* to 1*d* are primary-transferred onto the intermediate transfer belt 8. These four-color images are formed using a predetermined positional relationship for forming a full-color image. Thereafter, toner remaining on the surfaces of the photosensitive drums 1*a* to 1*d* is removed by cleaning units 5*a* to 5*d* in preparation for the subsequent formation of new electrostatic latent images.

The intermediate transfer belt 8 is stretched over a driven roller 10, a driving roller 11, and a tension roller 20. When the intermediate transfer belt 8 begins its clockwise rotation due to the rotation of the driving roller 11, the paper P is transported from the register roller pair 12*b* to a secondary transfer nip between the intermediate transfer belt 8 and the secondary transfer roller 9, located next to the intermediate transfer belt 8, at a predetermined timing. A full-color image is transferred onto the paper P at the secondary transfer nip. The paper P, on which the full color toner image has been transferred, is transported to the fixing unit 7.

The paper P is then heated and pressed as the paper P passes through a nipping portion (fixing nipping portion) of a fixing roller pair 13. The toner image is thereby fixed to the surface of the paper P to form a full-color image. The direction in which the paper P having the full-color image is fed, is divided by a diverging unit 14 that allows paper to be fed in a plurality of directions. In a situation where an image is formed only on one side of the paper P, the paper P exits to an output tray 17 by an output roller pair 15.

On the other hand, in the situation where images are formed on both sides of the paper P, part of the paper P that has passed through the fixing unit 7 temporarily protrudes from the output roller pair 15 to the outside of the apparatus 100. Thereafter, the paper P is fed in a reverse direction by reversely rotating the output roller pair 15. The paper is fed to a paper transport path 18 by the diverging unit 14 and fed again to the secondary transfer nip, with the image surface being reversed. The next image that is formed on the intermediate transfer belt 8 is then transferred to the surface of the paper P that does not bear an image, by the secondary transfer roller 9. The paper P is then fed to the fixing unit 7, where the toner image is fixed, and then to the output tray 17.

Figure 2:
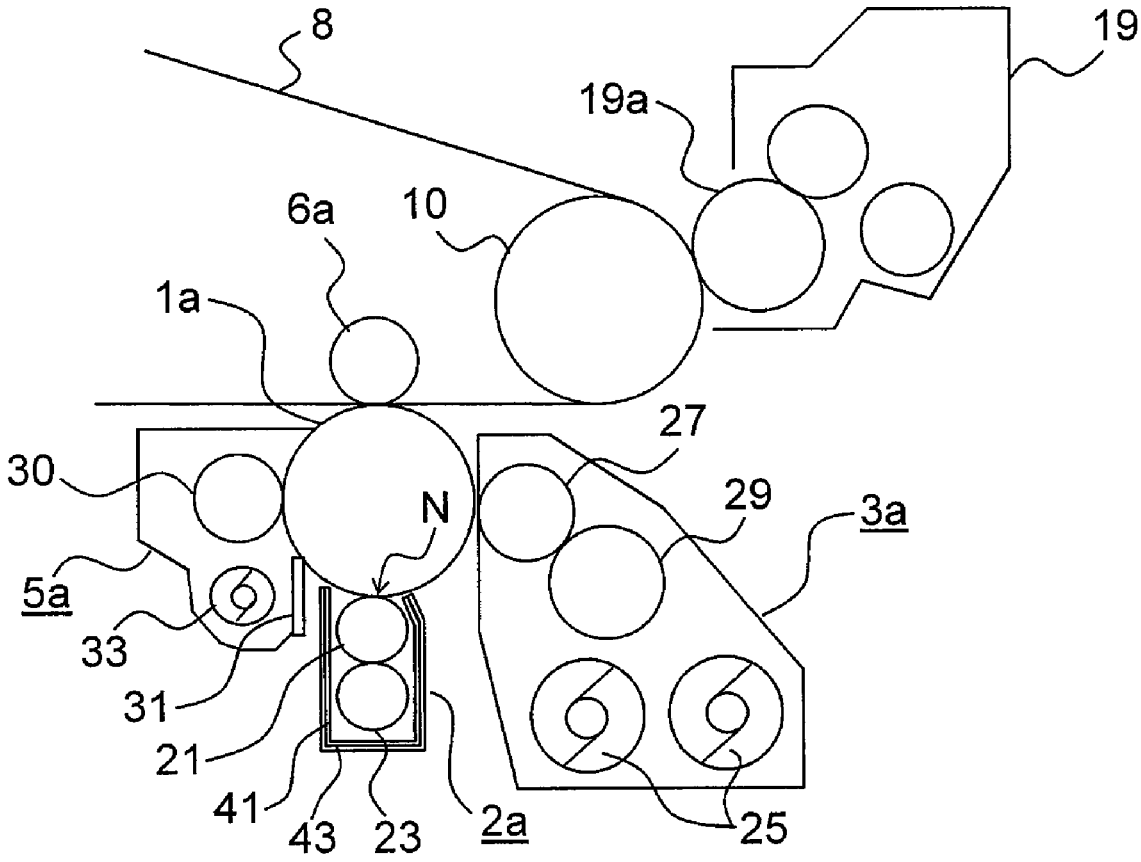
FIG. 2 is a fragmentary enlarged view of an embodiment of the image forming unit of FIG. 1.
Figure 3:
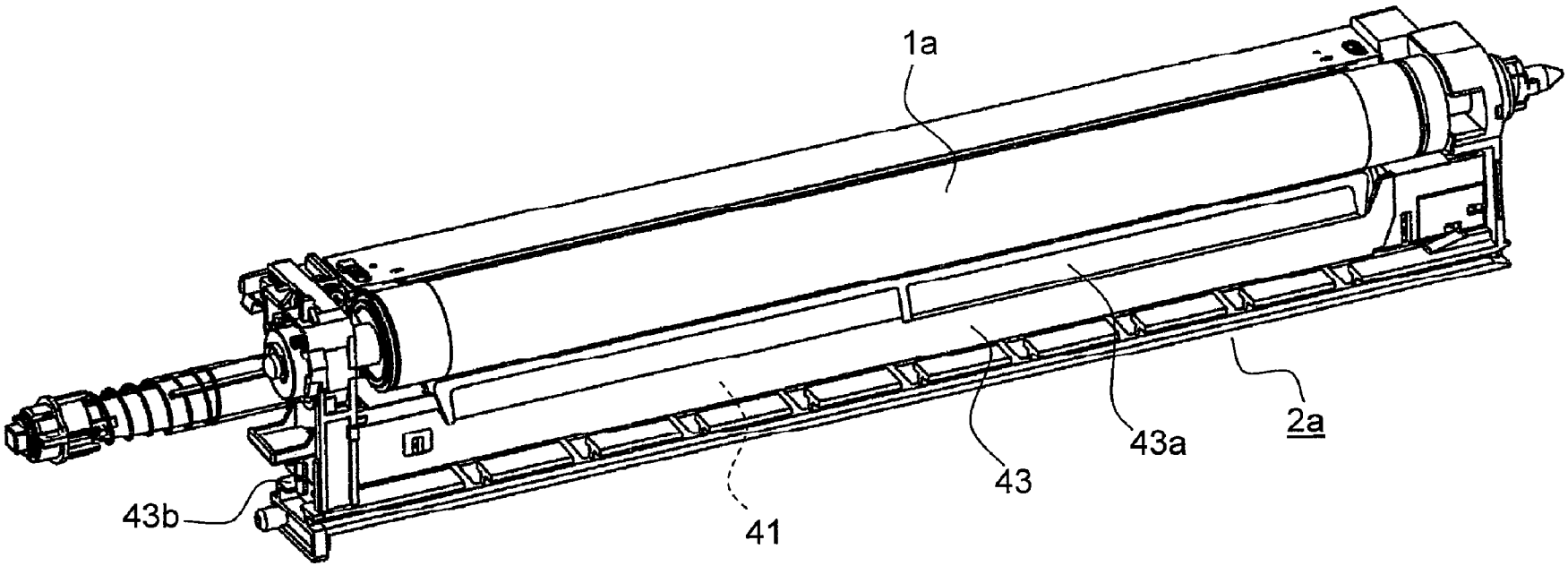
FIG. 3 is a perspective view showing the photosensitive drum and a charging unit of an embodiment of the present invention.
Figure 4:
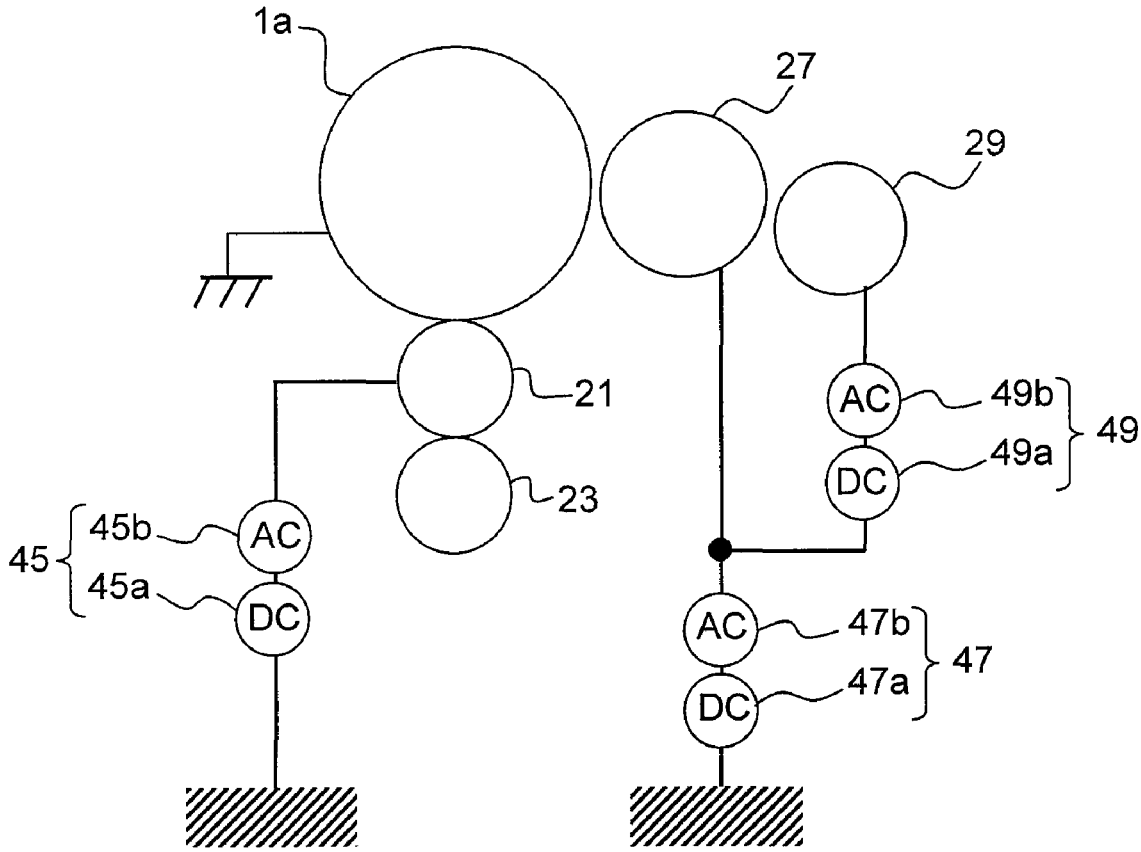
FIG. 4 is a diagram showing the electrical connection between a charging roller, a developing unit, and first, second, and third power sources of an embodiment of the present invention.

FIG. 2 is an enlarged view of a part of the image forming unit Pa of FIG. 1; FIG. 3 is a perspective view showing the photosensitive drum 1*a* and the charging unit 2*a*; and FIG. 4 is a diagram showing the electrical connection between the charging roller 21, the developing unit 3*a*, and first, second, and third power sources 45, 47, and 49. Since the image forming units Pb to Pd have substantially the same configuration as the image forming unit Pa, descriptions thereof will be omitted.

Around the photosensitive drum 1*a*, the charging unit 2*a*, the developing unit 3*a*, and the cleaning unit 5*a* are positioned along the rotational direction of the photosensitive drum 1*a* (counterclockwise in FIG. 2). The primary transfer roller 6*a* is located, with the intermediate transfer belt 8, therebetween. The belt cleaning unit 19, having a belt cleaning roller 19*a* that is positioned opposite the driven roller 10, with the intermediate transfer belt 8 therebetween, is located upstream of the photosensitive drum 1*a*, in the rotational direction of the intermediate transfer belt 8.

As shown in FIGS. 2 and 3, the charging unit 2*a* includes the charging roller (charging member) 21, that is in contact with the photosensitive drum 1*a* so as to apply a charging bias onto the surface of the photosensitive drum 1*a*. The charging unit 2*a* includes a charge cleaning roller 23, formed of a brush roller or the like, for cleaning the charging roller 21. A casing (an insulating casing) 41 surrounds the charging roller 21 and the charge cleaning roller 23. A metal shield member 43 is also provided. The casing 41 and the metal shield member 43 will be described hereinafter.

The charging roller 21 is in pressure contact with the photosensitive drum 1*a*, at a predetermined nip pressure, and rotates with the photosensitive drum 1*a*. The charging roller 21 is preferably of a solid type, such as a conductive rubber roller having a surface layer made of, for example, epichlorohydrin rubber with a resistance of $10^5$ to $10^6\Omega$ and a surface roughness of $R_Z$=10 μm; however, the roller may be of any type and is not limited thereto. For example, the charging roller 21 may be of a sponge type wherein a foam rubber roller is provided that is covered with a tube, a conductive brush roller, or the like.

As shown in FIG. 4, a first power source 45 formed of a direct-current power source 45*a* and an alternate-current power source 45*b* is electrically connected to the shaft of the charging roller 21. Therefore, a charging bias can be applied to the charging roller 21. In a situation where positively charged toner is used, the photosensitive drum 1*a* is positively charged by application of a positive-polarity (charging polarity, hereinafter simply referred to as positive) charging bias to the charging roller 21. The photosensitive drum 1*a*, that is charged by the charging roller 21, is exposed to light by the exposure unit 4, thereby forming an electrostatic latent image on the photosensitive drum 1*a*.

As shown in FIG. 2, the developing unit 3*a* uses jumping development and includes two stirring transport screws 25, the developing roller 27, and a magnetic roller 29 that functions as a toner supply member. The developing unit 3*a* applies a developing bias having the same polarity (positive) as that of the toner. This thereby electrically attracts the toner onto the surface of the photosensitive drum 1*a*. The developing roller 27 has a toner layer that is formed of toner supplied from the magnetic brush (described below), and electrically attracts the toner from the toner layer developing the electrostatic latent image on the photosensitive drum 1*a*.

The surface of the developing roller 27 consists of a sleeve having a uniformly conductive material such as aluminum, stainless steel, a conductive resin coating, or the like. As shown in FIG. 4, a second power source (voltage application unit) formed of a direct-current power source 47*a* and an alternate-current power source 47*b* is connected to the shaft of the developing roller 27. Thus, a first developing bias (developing bias) having a direct-current component and an alternating-current component is applied to the developing roller 27.

The magnetic roller 29 includes a rotatable cylinder consisting of a nonmagnetic metallic material and a plurality of stationary magnets inside the rotatable cylinder. A gap is provided between the plurality of stationary magnets and the rotatable cylinder. The magnets cause a magnetic brush having the developer to be generated on the surface of the magnetic roller 29. The thickness of the magnetic brush is regulated by a regulating blade (not shown). As shown in FIG. 4, a third power source (voltage application unit) 49, formed of a direct-current power source 49*a* and an alternate-current power source 49*b*, is connected to the shaft of the magnetic roller 29. Thus, a second developing bias (developing bias) having a direct-current component and an alternating-current component is applied to the magnetic roller 29.

The third power source 49 is electrically connected to a ground that is common to the second power source 47 and can apply a second developing bias, that is superposed on the first developing bias, to the magnetic roller 29. This allows the first and second developing biases to be separately set, preventing the combined waveform of the bias formed between the developing roller 27 and the magnetic roller 29 from being influenced by the second developing bias of the third power source 49, thus improving the developing performance.

However, the method for applying the first and second developing biases to the developing roller 27 and the magnetic roller 29 is not limited thereto. Thus, the second and third power sources 47 and 49 can be electrically connected to different grounds.

As shown in FIG. 2, the toner supplied from a toner container (not shown) circulates in the developing unit 3*a* with the carrier while being stirred by the stirring transport screws 25 in the developing unit 3*a*. The toner is thereby charged due to the friction between the toner and the carrier and is transported to the magnetic roller 29 by the stirring transport screws 25.

The developer forms a magnetic brush on the magnetic roller 29. The thickness of the magnetic brush is regulated by the regulating blade (not shown). The magnetic brush comes into contact with or is near to the developing roller 27 at a predetermined thickness to form a toner layer (thin toner layer) on the developing roller 27 with a potential difference being created between the magnetic roller 29 and the developing roller 27 due to the first and second developing biases.

Because of the potential difference between the developing roller 27 and the photosensitive drum 1*a* due to the first developing bias and surface potential of the photosensitive drum 1*a*, the toner located on the developing roller 27 is attracted to the photosensitive drum 1*a*. A toner image is thereby created on the photosensitive drum 1*a*. The toner remaining on the developing roller 27, after the development step, is collected by the magnetic brush on the magnetic roller 29 and also due to the potential difference between the developing roller 27 and the magnetic roller 29. The collected toner is dropped to the developer in the developing unit 3*a* with the carrier, due to the magnetic field produced by the magnets in the magnetic roller 29. The toner is stirred and then transported by the stirring transport screws 25, thus, circulation of the toner is boosted.

Examples of toner that can be used in the present invention include toners having external additive particles, such as silica, titanium oxide, strontium titanate, alumina, or the like, embedded in the surface thereof so as to partially protrude and toner in which external additive particles are electrostatically attached on the surface thereof. Examples of carriers include magnetite carriers, such as Mn-ferrite, Mn—Mg ferrite, Cu—Zn ferrite, and resin carriers in which magnetic substances are dispersed in the resin. Also, carrier having a treated surface can be used and its surface still maintains an appropriate resistance within a range in which the resistance is not increased beyond even after the treatment (on its surface).

As shown in FIG. 2, the cleaning unit 5*a* includes a sliding friction roller 30, a cleaning blade 31, and a recovery screw 33. Toner, remaining after the primary transfer, is removed from the surface of the photosensitive drum 1*a* using the sliding friction roller 30 and the cleaning blade 31. The removed toner is discharged from the cleaning unit 5*a* due to the rotation of the recovery screw 33.

As described above, the charging bias is applied from the first power source 45 to the charging roller 21, and the first and second developing biases are applied from the second and third power sources 47 and 49 to the developing roller 27 and the magnetic roller 29, respectively. However, if the charging bias and the first and second developing biases are applied near each other at the same time, it is possible that the alternate-current components of the first and second developing biases will interfere with the charging bias, due to electromagnetic induction or the like of the wires in the high-voltage power board (not shown), the charging unit 2*a*, and the developing unit 3*a* themselves.

The interference caused by the first and second developing biases with the charging bias causes a blurred image, thus causing a reduction in image quality. Therefore, a metal shield member 43 is provided around the casing 41 of the charging unit 2*a*, as described below.

As shown in FIGS. 2 and 3, the charging unit 2*a* has a U-shaped cross-sectional casing 41 including a opening at an opposing portion N of the charging roller 21 and the photosensitive drum 1*a* (see FIG. 2), around the charging roller 21 and the charge cleaning roller 23.

Figure 5:
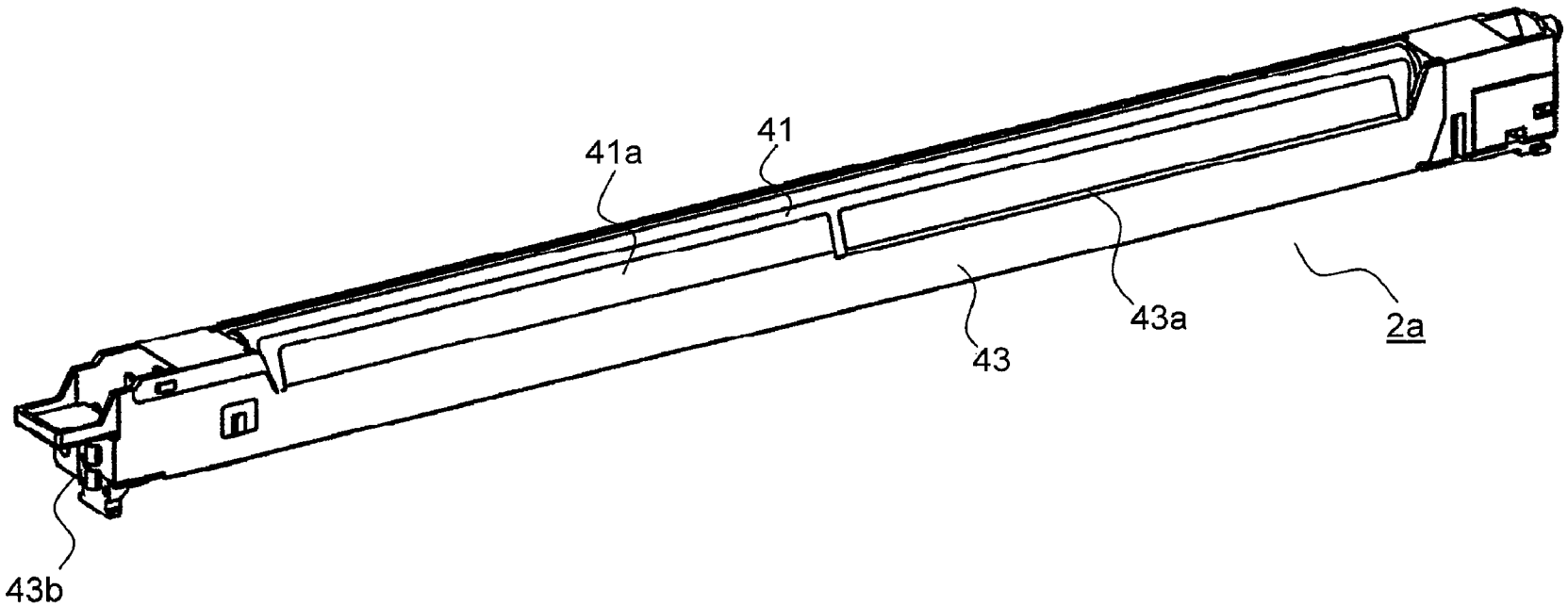
FIG. 5 is a perspective view of an embodiment of the charging unit of the present invention.
Figure 6:
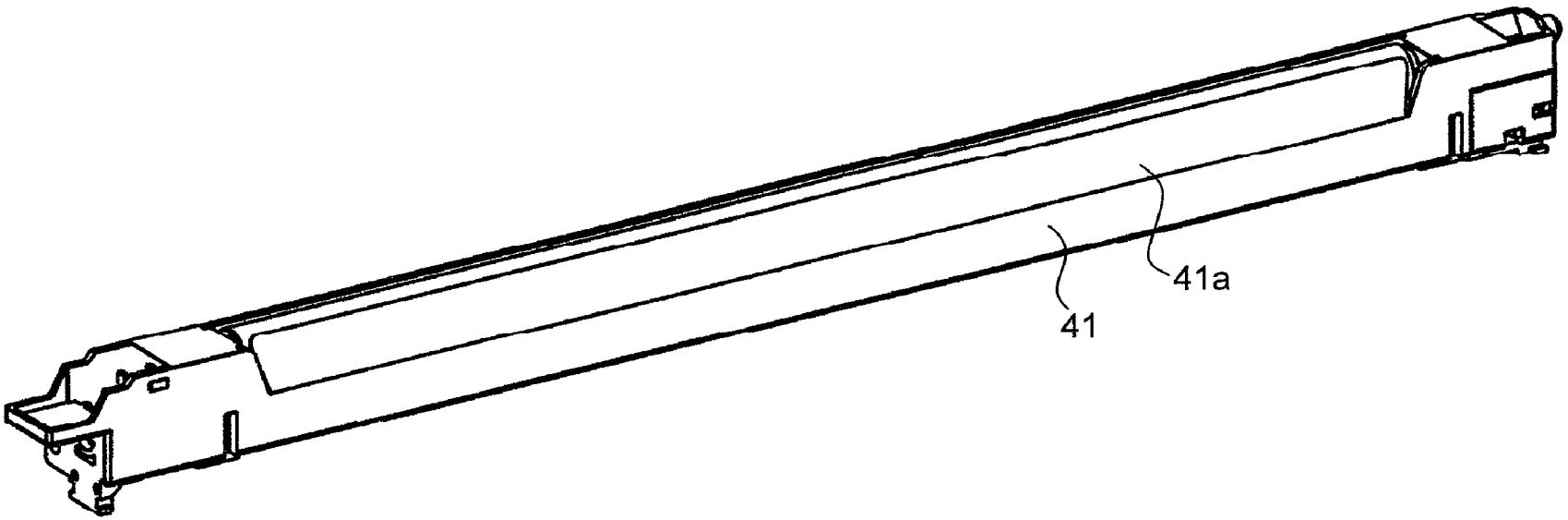
FIG. 6 is a perspective view of an embodiment of a casing of the present invention.
Figure 7:
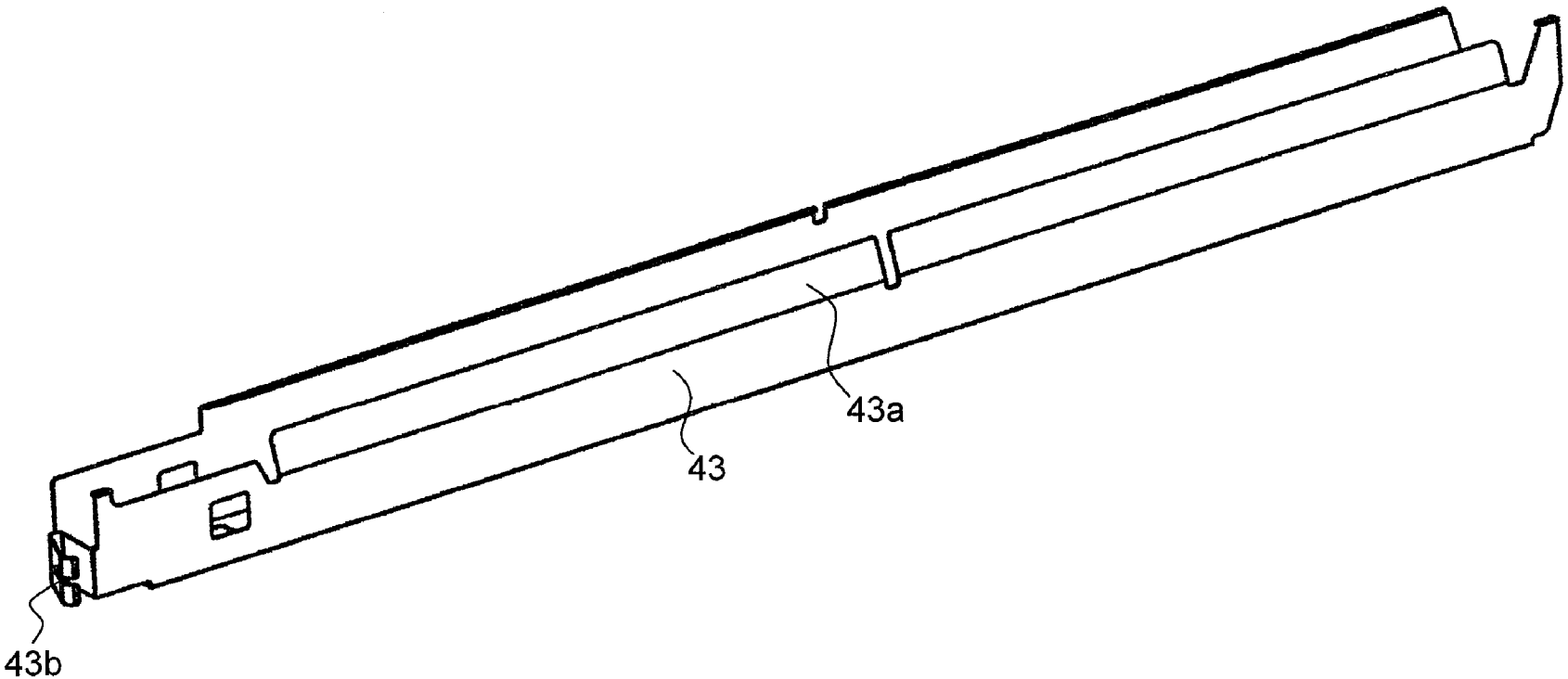
FIG. 7 is a perspective view of an embodiment of a shield member of the present invention.
Figure 8:
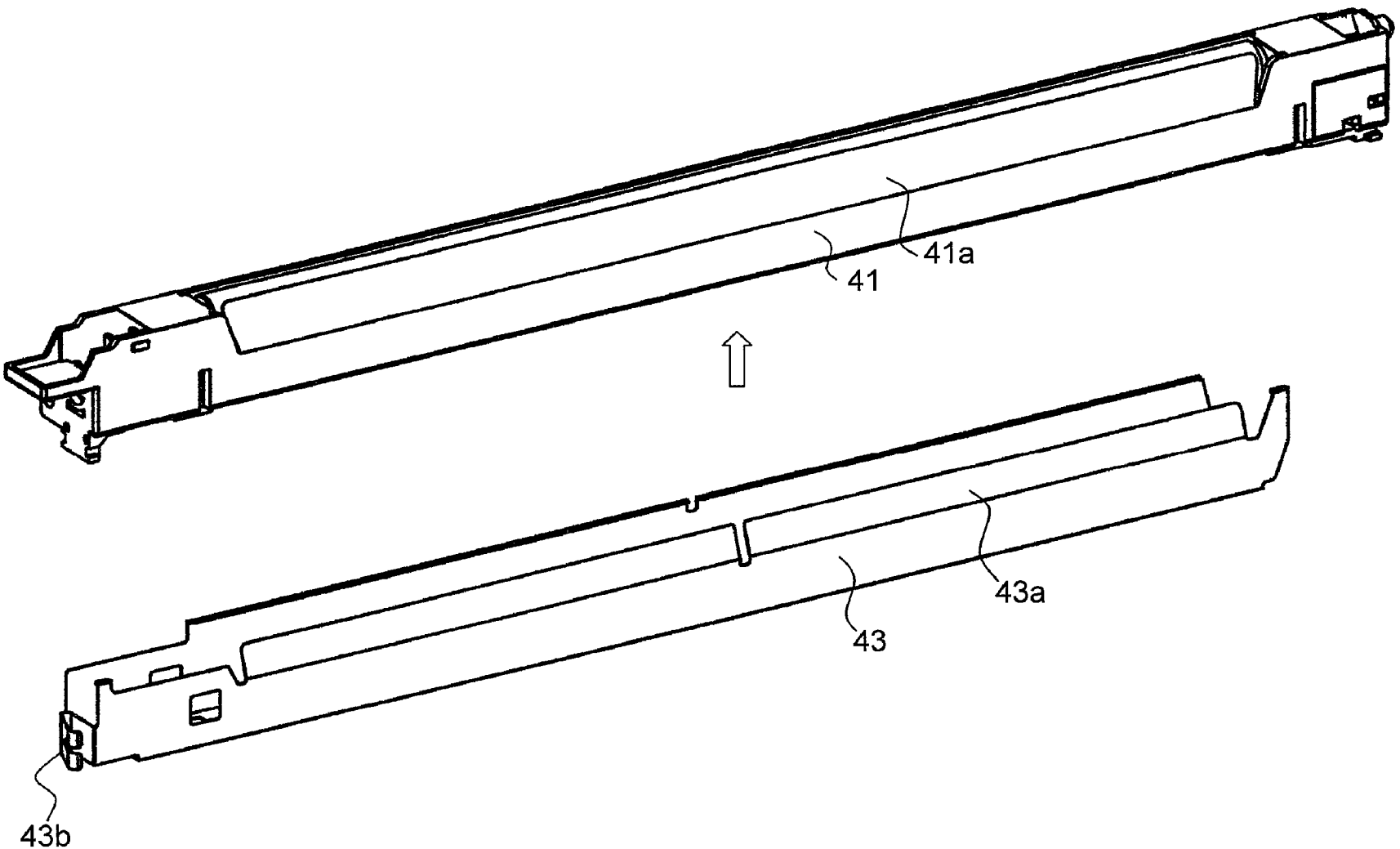
FIG. 8 is a diagram showing an embodiment of the operation to assemble the shield member to the casing of the present invention.

FIG. 5 is a perspective view of the charging unit 2*a*; FIG. 6 is a perspective view of the casing 41; FIG. 7 is a perspective view of the metal shield member 43; and FIG. 8 is a diagram showing the assembly of the metal shield member 43 to the casing 41. In FIGS. 5 to 8, the charging roller 21 and the charge cleaning roller 23 are omitted for the sake of convenience.

As shown in FIGS. 5 and 6, a first end 41*a* of the U-shape of the casing 41 on the developing unit 3*a* side is inclined toward the charging roller 21 (see FIG. 2). The casing 41 consists of an insulating material, such as resin, so as to provide insulating properties. As shown in FIG. 5, the metal shield member 43 surrounds the casing 41. The metal shield member 43 can consist of, for example, stainless steel.

As shown in FIGS. 5 and 7, the metal shield member 43 is U-shaped along the outer peripheral surface of the casing 41 and is positioned in close contact with the outer peripheral surface of the casing 41. A second end 43*a* of the U-shape of the metal shield member 43, on the developing unit 3*a* side (see FIG. 2), is inclined toward the charging roller 21 along the first end 41*a* of the casing 41.

The end of the metal shield member 43 on the front side of the apparatus main body, in the longitudinal direction (the left side in FIGS. 5 and 7), extends outwardly and is bent in a U-shape in a direction perpendicular to the longitudinal direction, to form a flat-spring grounding portion 43*b*. The grounding portion 43*b* is in contact with a metal contact portion (not shown) of the apparatus main body to electrically contact with the ground. As shown in FIG. 8, the metal shield member 43 is fitted onto the casing 41 from below the casing 41, with the metal shield member 43 being in close contact with the outer peripheral surface of the casing 41.

By way of example, a voltage, having a direct-current component Vdc1 of 500 V, an alternating-current component Vpp1 of 1.2 kV, and a frequency of 2 kHz, is applied to the charging roller 21 from the direct-current power source 45*a* and the alternate-current power source 45*b* of the first power source 45. A voltage, having a direct-current component Vdc2 of 70 V, an alternating-current component Vpp2 of 1.5 kV, and a frequency of 4.7 kHz, is applied to the developing roller 27 from the direct-current power source 47*a* and the alternate-current power source 47*b* of the second power source 47.

A voltage, having a direct-current component Vdc3 of 370 V, an alternating-current component Vpp3 of 2.3 kV, and a frequency of 4.7 kHz, is applied to the magnetic roller 29 from the direct-current power source 49*a* and the alternate-current power source 49*b* of the third power source 49. Accordingly, the difference between the charging bias Vpp1 applied to the charging roller 21 and the first developing bias Vpp2 applied to the developing roller 27 is set at 0.3 kV. The difference between the charging bias Vpp1 applied to the charging roller 21 and the second developing bias Vpp3 applied to the magnetic roller 29 is set at 1.1 kV.

In this embodiment, the difference between Vpp1 and Vpp3 is greater than the difference between Vpp1 and Vpp2; therefore, it is possible that the second developing bias applied to the magnetic roller 29 will exert a greater influence on the charging bias than the first developing bias applied to the developing roller 27. However, when image formation was performed with such bias setting, image degradation, such as blurriness or unevenness, did not occur.

That is, in this embodiment, even if the difference in Vpp between the charging bias and the developing bias is as great as 1.1 kV, interference of the developing bias with the charging bias can be prevented, thus allowing image degradation, such as blurriness or unevenness, to be sufficiently prevented. Moreover, image degradation due to development failure did not occur.

Since the outer periphery of the casing 41 is surrounded by the metal shield member 43, and the metal shield member 43 is in close contact with the outer peripheral surface of the casing 41, as described above, they can be assembled and disassembled as one piece. This can improve the detachability and maintenance of the charging unit 2*a* and can decrease the size of the charging unit 2*a*.

Since the periphery of the casing 41 is surrounded by the metal shield member 43, the area of the opposing portion N of the charging roller 21 and the photosensitive drum 1*a* (see FIG. 2) to which the charging bias is applied is blocked from the first and second developing biases that are applied to the developing roller 27 and the magnetic roller 29 of the developing unit 3*a*, respectively.

In addition, since the metal shield member 43 is in close contact with the outer peripheral surface of the casing 41, the metal shield member 43 can be located close to the opposing portion N. This can reduce the space around the opposing portion N, that is, by the charging bias, that is not surrounded by the metal shield member 43.

Accordingly, this can prevent the first and second developing biases from interfering with the charging bias across the shield member 41 and the alternating-current component of the electric field from being induced into the charging bias. This can prevent the first and second developing biases from interfering with the charging bias and influencing the charging bias, thus stabilizing the charging of the photosensitive drum 1*a*.

Furthermore, in this embodiment, since the metal shield member 43 has a cross sectional U-shape having the opening at the opposing portion N between the charging roller 21 and the photosensitive drum 1*a*, and the second end 43*a* of the metal shield member 43 inclines toward the charging roller 21, the area by the charging bias, which is not surrounded by the metal shield member 43, is reduced. This reduces the influence of electric fields that leak from the first and second developing biases, on the charging bias.

The end of the U-shape of the metal shield member 43 that is adjacent to the cleaning unit 5*a* (see FIG. 2) can also be inclined toward the charging roller 21. This can further reduce the influence of electric fields leak from adjacent developing unit 3*b* (see FIG. 1) on the charging bias applied to the charging roller 21. Both ends of the metal shield member 43 may be inclined toward the charging roller 21. Alternatively, both ends of the metal shield member 43 may not be inclined.

Here, although the first end 41*a* of the U-shape of the casing 41 is also inclined toward the charging roller 21, with the second end 43*a* of the metal shield member 43, only the second end 43*a* of the metal shield member 43 may be inclined toward the charging roller 21. In such a case, for example, the first end 41*a* of the casing 41 may not be inclined and can be shorter than the second end 43*a* of the metal shield member 43, and only the second end 43*a*, which protrudes toward the photosensitive drum 1*a* more than the first end 41*a*, may be inclined.

In an embodiment, the metal shield member 43 has a flat-spring grounding portion 43*b*. This further ensures grounding, thus further preventing any influence from electric fields from the first and second developing biases on the charging bias. However, the method for the grounding is not particularly limiting; all that is necessary is that the metal shield member 43 is grounded. The grounding portion 43*b* may either be integrally formed with the metal shield member 43 or be separately formed and thereafter be mounted to the metal shield member 43.

In an embodiment, an image forming apparatus 100 is provided that includes the charging unit 2*a*, the photosensitive drum 1*a*, the exposure unit 4, and the developing unit 3*a*. Pursuant to the present invention, an image, in which unevenness in charging is prevented, can be formed.

In an embodiment, the developing unit 3*a* includes a developing roller 27 that faces the photosensitive drum 1*a* without contact therewith. The developing unit 3*a* includes a magnetic roller 29 that forms a thin toner layer on the developing roller 27 using a magnetic brush, and second and third power sources 47 and 49 that apply first and second developing biases each formed of direct-current and alternating-current components to the developing roller 27 and the magnetic roller 29, respectively. Therefore, the charging can be stabilized even when the first developing bias and the second developing bias is prone to exert an influence on the charging bias.

Methods for using the developing unit 3*a* are not limited to this embodiment; development can be performed using only the developing roller 27 without using the magnetic roller 29. In such a situation, the developing roller 27 having a sleeve consisted of, for example, a magnetic material, may be used. A magnetic brush may be formed on the developing roller 27. Toner may be electrically attracted from the magnetic brush onto the photosensitive drum 1*a*.

Although the photosensitive drum 1*a*, the charging unit 2*a*, and the developing unit 3*a* located in the image forming unit Pa have been described, the charging units 2*b* to 2*d* and the developing units 3*b* to 3*d* located in the image forming units Pb to Pd, respectively, have substantially the same configurations and offer the same operational advantages.

For example, in the above-described embodiment, a belt cleaning unit 19 equipped with the belt cleaning roller 19*a* is used as a means for cleaning the intermediate transfer belt 8. However, a belt cleaning unit 19 equipped with a belt cleaning blade, instead of the belt cleaning roller 19*a*, may be used.

Although an embodiment uses a charge cleaning roller 23, this charge cleaning roller 23 is not required, and may not be used. Although in an embodiment, a contact charging unit 2*a* having the charging roller 21 is used as a charging unit, a noncontact charging unit, such as a scorotron charging unit or a corotron charging unit, may be used.

The present invention can be applied to various image forming apparatuses that charge the surface of the photosensitive member using a charging unit. Such apparatus include digital multi-functional peripherals, copying machines, such as tandem color copying machines and analog monochrome copying machines, facsimile machines, and laser printers.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A charging unit in an image forming apparatus for charging the surface of an image-bearing member comprising:

a charging member;

an insulating casing surrounding the charging member; and a metal shield member surrounding the casing, the metal shield member being located in close contact with an outer peripheral surface of the insulating casing.

2. The charging unit according to claim 1, wherein the metal shield member has a cross sectional U-shape having an opening at an opposing portion of the charging member and the image-bearing member, at least one end of the metal shield member being inclined toward the charging member.

3. The charging unit according to claim 1, wherein the metal shield member is bent at one end in a longitudinal direction to form a grounding portion.

4. The charging unit according to claim 2, wherein the metal shield member is bent at one end in a longitudinal direction to form a grounding portion.

5. An image forming apparatus comprising:

a charging unit;

an image-bearing member that is charged by the charging unit;

an exposing unit that irradiates light onto the image-bearing member that is charged by the charging unit to form an electrostatic latent image;

a developing unit that applies a developing bias including an alternating-current component to develop the electrostatic latent image; and the charging unit includes: a charging member; an insulating casing surrounding the charging member; and a metal shield member surrounding the casing, the metal shield member being located in close contact with an outer peripheral surface of the insulating casing.

6. The image forming apparatus according to claim 5, wherein the metal shield member has a cross sectional U-shape having an opening at an opposing portion of the charging member and the image-bearing member, at least one end of the shield member being inclined toward the charging member.

7. The image forming apparatus according to claim 5, wherein the metal shield member is bent at one end in a longitudinal direction to form a grounding portion.

8. The image forming apparatus according to claim 6, wherein the metal shield member is bent at one end in a longitudinal direction to form a grounding portion.

9. The image forming apparatus according to claim 5, wherein:

the developing unit includes:

a toner bearing member that does not contact and is located opposite to the image-bearing member;

a toner supply member that forms a thin toner layer on the toner bearing member using a magnetic brush; and a voltage application unit that applies a direct-current bias and an alternate-current bias to the toner supply member and the toner bearing member.

10. A method for forming images, the method comprising the steps of:

charging an image-bearing member using a charging unit;

irradiating light on the image-bearing member that is charged by the charging unit to form an electrostatic latent image using an exposing unit;

applying a developing bias including an alternating-current component to develop the electrostatic latent image using a developing unit; and shielding the charging unit using an insulating casing that surrounds a charging member and a metal shield member that surrounds the casing the metal shield member being located in close contact with an outer peripheral surface of the insulating casing.

* * * * *